US005402608A

United States Patent [19]

Chu

[11] Patent Number: 5,402,608

[45] Date of Patent: Apr. 4, 1995

[54] PREFABRICATED BUILT-UP BUILDING CONSTRUCTION

[76] Inventor: Rey-Chin Chu, 1Fl. No. 124, Alley 76, Lane 600 Wu Shing Street, Taipei, Taiwan, Prov. of China

[21] Appl. No.: 12,450

[22] Filed: Feb. 2, 1993

[30] Foreign Application Priority Data

Feb. 27, 1992 [GB] United Kingdom ..... 9204242

[51] Int. Cl.[6] ..... E04B 1/348

[52] U.S. Cl. ..... 52/79.1; 52/79.9; 52/745.2

[58] Field of Search ..... 52/79.1, 79.9, 637, 52/236.3, 745.2, 127.2

[56] References Cited

U.S. PATENT DOCUMENTS

| | | | |
|---|---|---|---|
| 2,177,699 | 10/1939 | Fisher | 52/280 |
| 3,526,067 | 9/1970 | Furter et al. | 52/79.1 |
| 3,631,648 | 1/1972 | Filipek et al. | 52/79.1 |
| 3,927,498 | 12/1975 | Benedetti | 52/79.1 |
| 4,010,579 | 3/1977 | Galvagni | 52/79.9 |
| 4,012,871 | 3/1977 | Netto et al. | 52/79.1 |
| 4,045,937 | 9/1977 | Stucky | 52/79.1 |
| 4,513,545 | 4/1985 | Hopkins, Jr. | 52/79.1 |
| 4,854,094 | 8/1989 | Clark | 52/79.9 |
| 5,195,282 | 3/1993 | Campbell | 52/79.1 |

FOREIGN PATENT DOCUMENTS

| | | | |
|---|---|---|---|
| 0512932 | 11/1992 | European Pat. Off. | 52/79.1 |
| 2325621 | 12/1974 | Germany | 52/79.12 |
| 2719953 | 7/1978 | Germany | 52/79.9 |
| 2705385 | 8/1978 | Germany | 52/79.1 |
| 2040334 | 8/1980 | United Kingdom | 52/79.9 |
| 8600948 | 2/1986 | WIPO | 52/79.9 |

*Primary Examiner*—Carl D. Friedman
*Assistant Examiner*—Wynn E. Wood
*Attorney, Agent, or Firm*—Bacon & Thomas

[57] ABSTRACT

Disclosed is a prefabricated build-up building construction for taking a built-up building by connecting structural units together, each structural unit being rode by connecting steel columns and beams into steel frames in shapes and sizes according to the construction plan of the building to be constructed, each steel frame being respectively constructed with braces, floor slabs, wall boards, windows, ladder and/or elevator hoistway. The structural units may be directly welded with one another, or fastened with connecting steel plates by bolts or through welding process and then connected-together by connecting each steel plate on one structural unit to an adjacent steel plate on another structural unit by a respective reinforcement plate through welding process.

4 Claims, 11 Drawing Sheets

PREFABRICATED BUILT-UP BUILDING CONSTRUCTION

BACKGROUND OF THE INVENTION

The present invention relates to building construct ions, and relates more particularly to a prefabricated built-up building construction for building up a building by connecting prefabricated structural units together.

The construction of a building is not an easy job. Before the construction of a building, a series of complicated procedures including geological prospecting, designing of the construction plan, etc., must be properly done. During the construction work, the foundation is firstly constructed, and then the structure of the building to be made is done. After the formation of the structure, floor slabs, wall boards, windows, water piping and electric wiring, air conditioner system, fire-fighting system, partitions, interior and exterior upholsters are respectively and properly made. According to conventional constructions, these procedures are made at the work-yard by various workers step by step. However, it is not easy to move manpower about according to needs. Quality control is another task difficult to achieve. In order to maintain the quality and reduce the cost, industrialized construction is the way to go. The so-called industrialized construction is to prefabricate most parts of a building at factory and then assemble the parts at the work-yard. Various prefabricated constructions have been proposed and applied for building a variety of houses. However, regular prefabricated constructions are simply to prepare floor slabs, wall boards and partition boards for quick installation after the construction of the structure for a building. Because the structure of a building is separately made at the work-yard, the cost, progress and quality of the building are still difficult to be controlled. There is also proposed a prefabricated reinforced concrete house construction. The size of a structural unit made according to this prefabricated reinforced concrete house construction is confined to the conditions of its transportation. In general, conventional constructions have various defects pending unsettled, which are outlined hereinafter.

1. A building constructed according to conventional methods is difficult to repair. Because the structure of a building is made of reinforced concrete or structural steels, and constructed at the work-yard, it cannot be pulled down or dismantled for a repair work when it is damaged after a fire or earthquake.

2. During the construction of a building, the nearby environment and traffic conditions will be unfavorably affected. According to conventional constructions, a variety of construction materials are frequently delivered to the work-yard and put here and there to obstruct the traffic.

3. The construction of a building according to conventional methods will cause environmental pollution. High noises, dusts and waste materials will be produced during the construction of a building in affecting the health and living conditions of the people living or working nearby.

4. The construction of a building according to conventional methods needs a long time schedule, and therefore the construction materials and manpower are difficult to control.

5. A building constructed according to conventional methods provides little flexibility. Once a building is constructed, it can not be conveniently moved from place to place.

6. It is expensive to construct a building according to conventional methods. Because the structure and most parts of the building is made at the work-yard, they cannot be made through mass production to reduce the unit cost.

7. A prefabricated house according to the prior art is to divide a house into several parts respective made at factory, then the parts are set up at the work-yard and then connected by concrete. Once a prefabricated house is set up, it cannot be pulled down and moved to another place, and its size can not be extended further.

8. A prefabricated reinforced concrete house constructed according to the prior art is limited in size. When installed, the wall bears the load and can not be pulled down. Therefore, is size can not be extended as desired.

SUMMARY OF THE INVENTION

An object of the present invention is to provide a prefabricated built-up building construction which allows the structure, floor slab, wall boards, ladder, window and elevator hoistway to be prefabricated at factory and then set up at the work-yard. Another object of the present invention is to provide a prefabricated built-up building construction which shortens the time schedule of the construction of a building. Still another object of the present invention is to provide a prefabricated built-up building construction which eliminates unfavorable influences to the nearby traffic during the construction of a building. Still another object of the present invention is to provide a prefabricated built-up building construction which allows a building to be conveniently pulled down and reassembled after its construction. Still another object of the present invention is to provide a prefabricated built-up building construction which makes the budget control of a building construction easy, According to the present invention, the prefabricated built-up building construction is to prefabricate structural units at factory, and then connect the structural units horizontally and vertically at the work-yard according to the construction plan. The structural units may be made in different sizes and shapes according to different requirements. They are made by connecting steel columns and beam into steel frames. Each steel frame is respectively constructed with braces, floor slabs, wall boards, windows, ladder and/or elevator hoistway. The structural units may be directly welded with one another, or fastened with connecting steel plates by bolts or through welding process and then connected together by connecting each steel plate on one structural unit to an adjacent steel plate on another structural unit by a respective reinforcement plate through welding process. Because less amount of jobs is to be done at the work-yard, industrialized construction can be achieved.

BRIEF DESCRIPTION OF THE DRAWINGS

FIG. 5-1 is a cross section in an enlarged scale showing the relative positions of a cone and a recessed taper hole;

FIG. 5-2 illustrates the cone engaged into the recessed taper hole;

DETAILED DESCRIPTION OF THE PREFERRED EMBODIMENT

Figure 1:
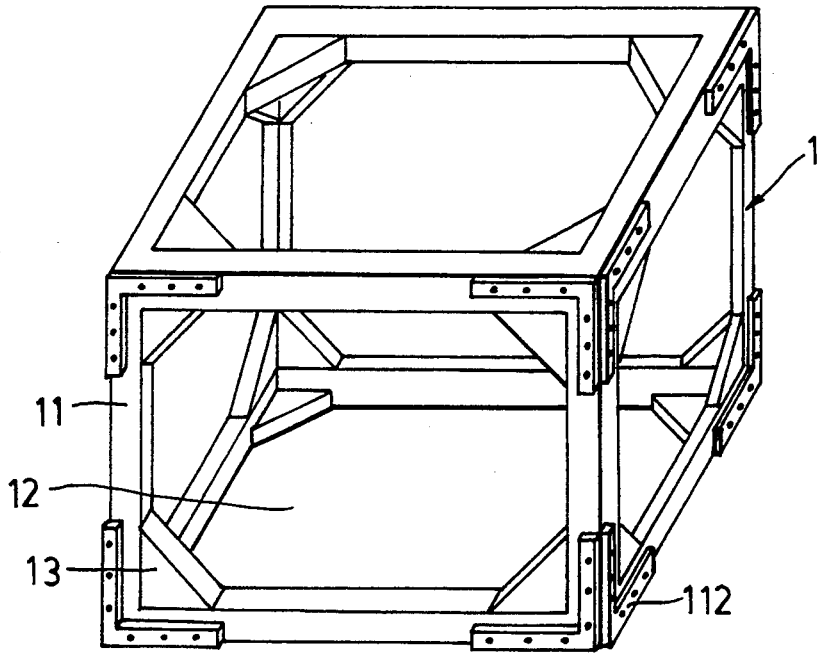
FIGS. 1, 1-1 and 2 illustrate several structural units made in different sizes (before mounting of wall boards, floor slabs, windows, ceiling, etc.) according to the present invention.
Figure 1:
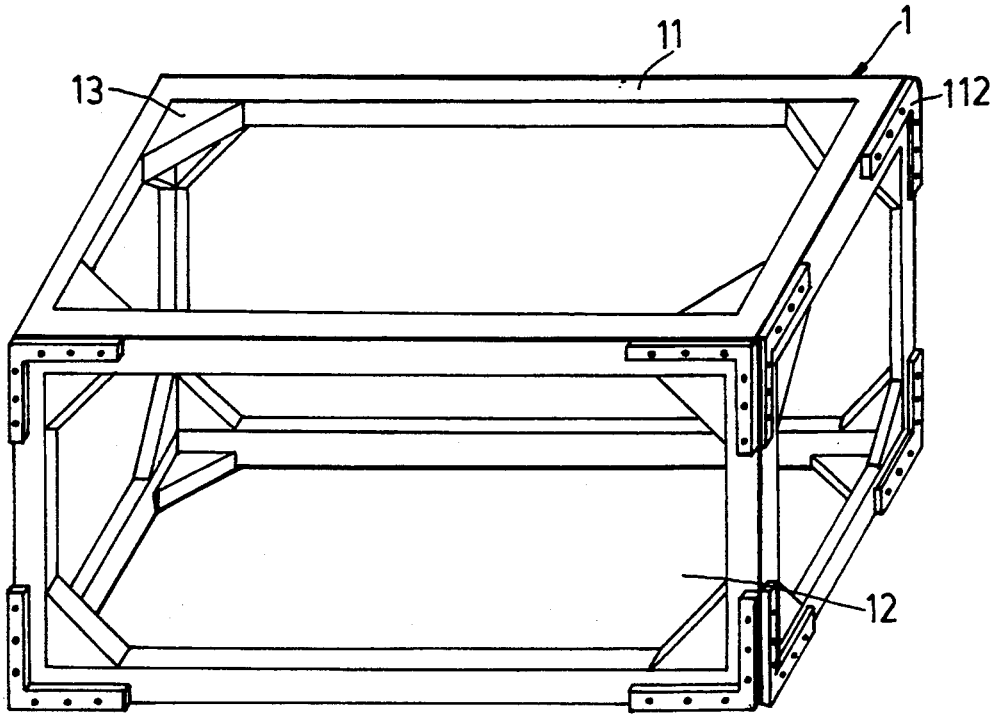
Figure 2:
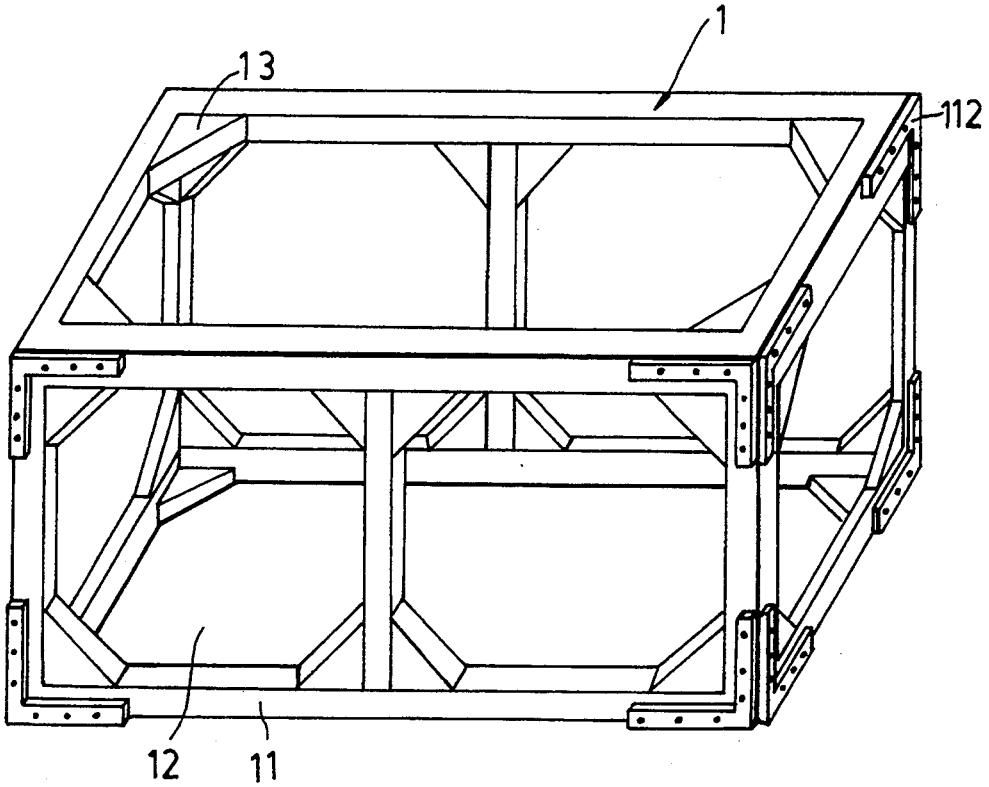
Figure 3:
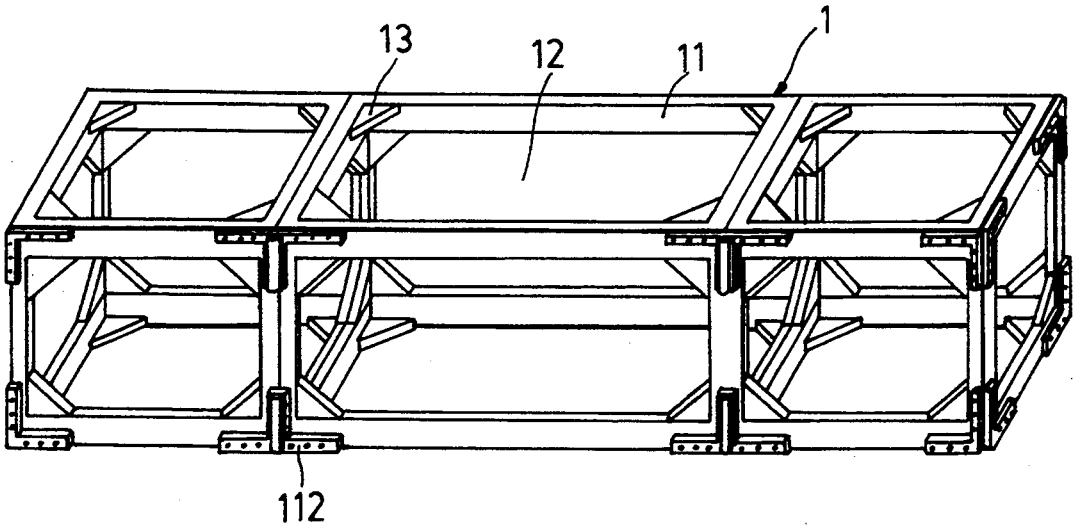
FIG. 3 illustrates several structural units connected horizontally.
Figure 4:
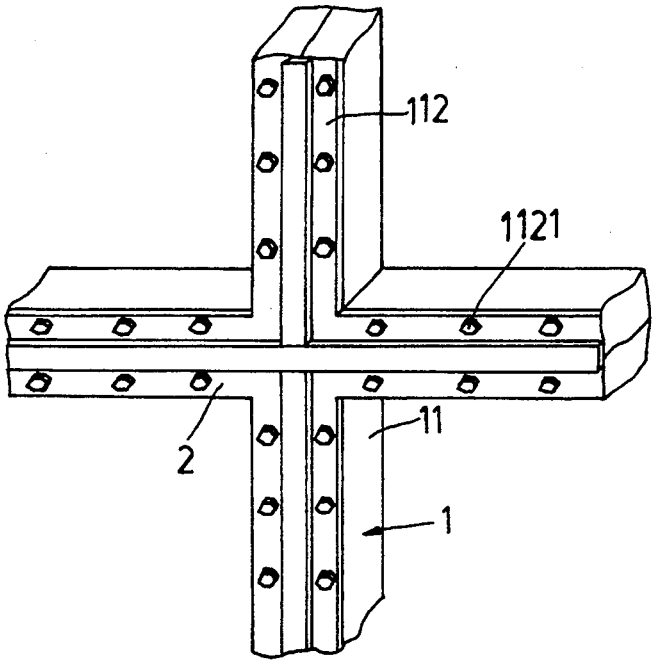
FIG. 4 illustrates connecting steel plates fastened to the steel columns and beams by bolts and connected one another by reinforcement plates through welding process.
Figure 5:
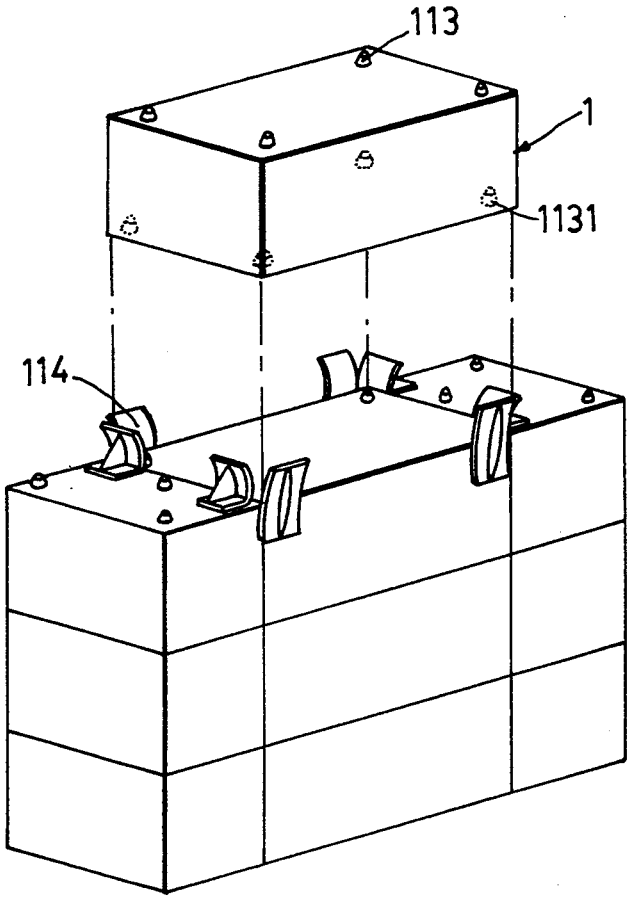
FIG. 5 illustrates cones and recessed taper holes respectively made on the bottom and top surfaces of each structural unit and guide members installed in place for guiding an upper structural unit into position.
Figures 1, 5:
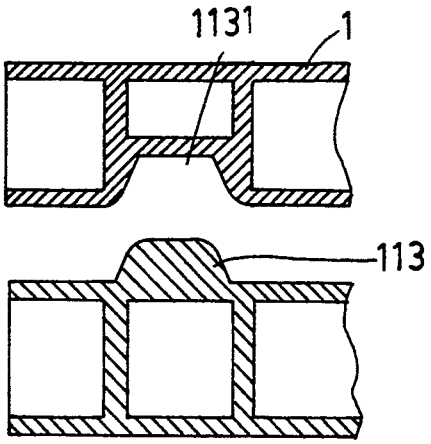
Figures 2, 5:
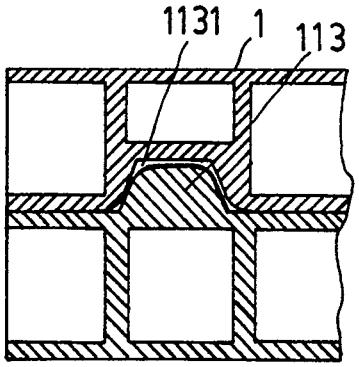
Figure 6:
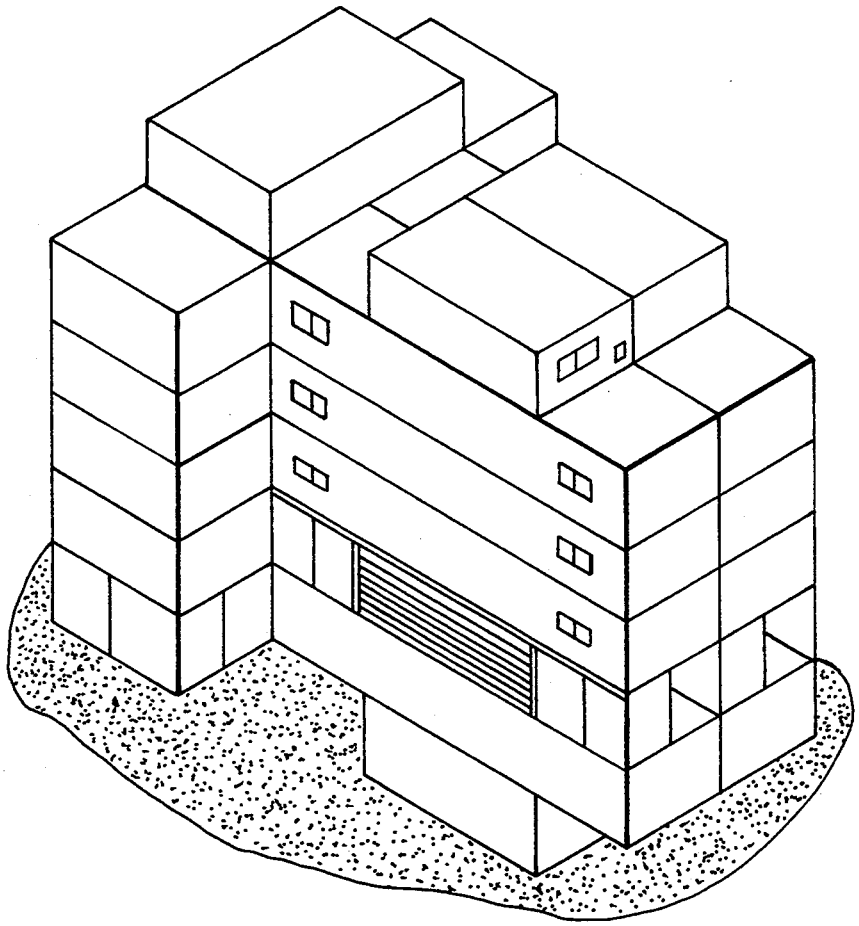
FIGS. 6, 7 and 8 illustrate several buildings constructed according to the present invention.
Figure 7:
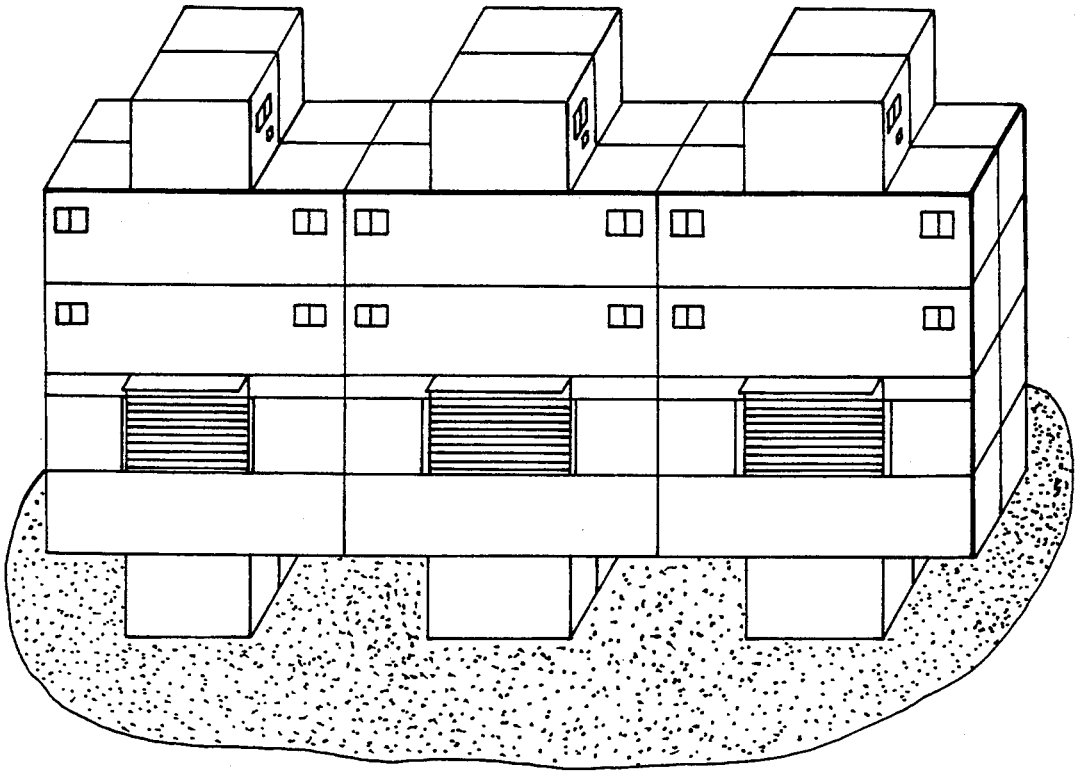
Figure 8:
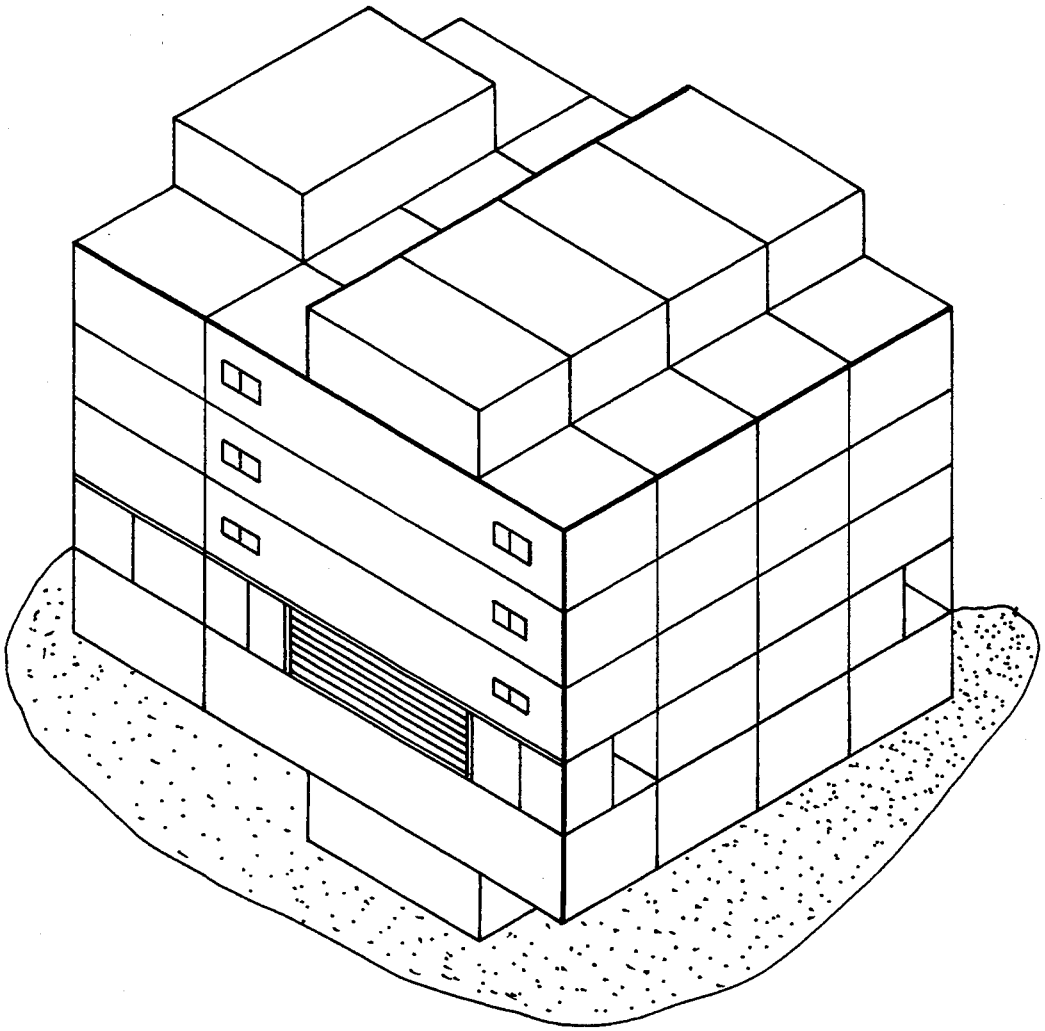
Figure 9:
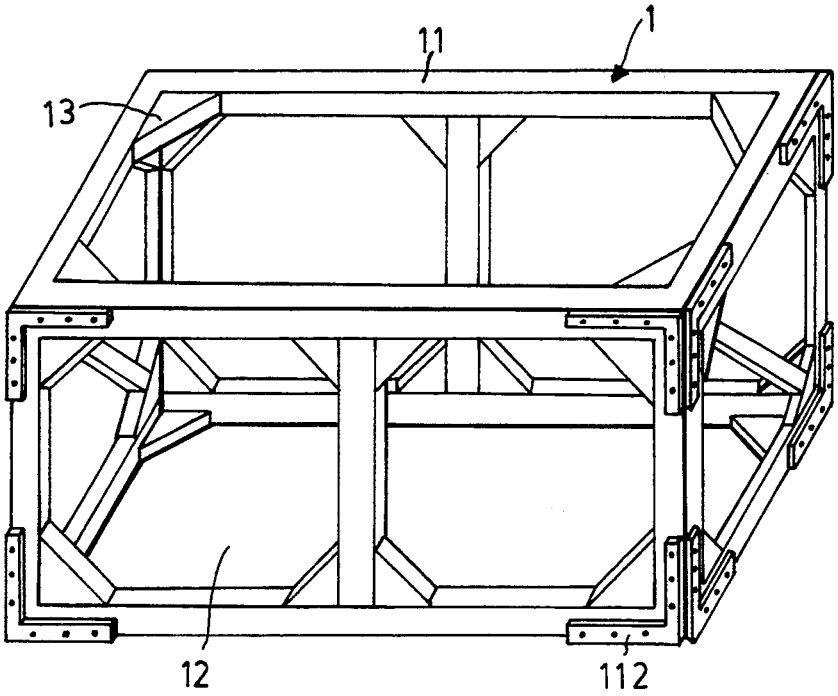
FIG. 9 illustrates an alternate form of the structural unit.

Referring to FIGS. 1, 1-1 and 2, structural units 1 which is consisted of steel columns and beams are made in the desired sizes and shapes, and then constructed with braces, floor slabs, wall boards, windows, ladder and/or elevator hoistway according to the construction plan.

Referring to FIGS. 3, 4, 5-1 and 5-2, reinforcing angle irons 13 are respectively fastened to the interior angles between the columns and beams of the structural unit 1; connecting steel plates 112 are respectively fastened to the columns and beams by bolts to connect prepared structural units 1 together; reinforcement plates 2 are respectively welded to the connecting steel plates 112 in connecting one structural unit to another. Cones 113 and recessed taper holes 1131 are respectively made on each structural unit 1 at the top or bottom (see FIG. 5-1). During the construction of the building, prepared structural units 1 may be respectively lifted by a construction hoist or like machine and then connected vertically by means of the guide of guide members 114. When two structural units 1 are piled up together, the cones 113 on the structural unit 1 at a lower elevation are respectively engaged into the recessed taper holes 1131 on the structural units 1 at a higher elevation. By means of engaging the sloping surface 1132 on the cones 113 with the sloping surface 1133 on the recessed taper holes 1131, the structural unit 1 at a higher elevation becomes firmly positioned on the structural unit 1 at a lower elevation. This arrangement eliminates positioning errors which may occur due to structural tolerance between two connected structural units 1. Therefore, prepared structural units 1 can be conveniently set up and formed into a building. The building thus constructed can be conveniently pulled down. By removing the bolts from the connecting steel plates 112, the connecting steel plates 112 and the reinforcement plates 2 are detached from the structural units 1, and then the structural units 1 can be separated from one another.

Figure 10:
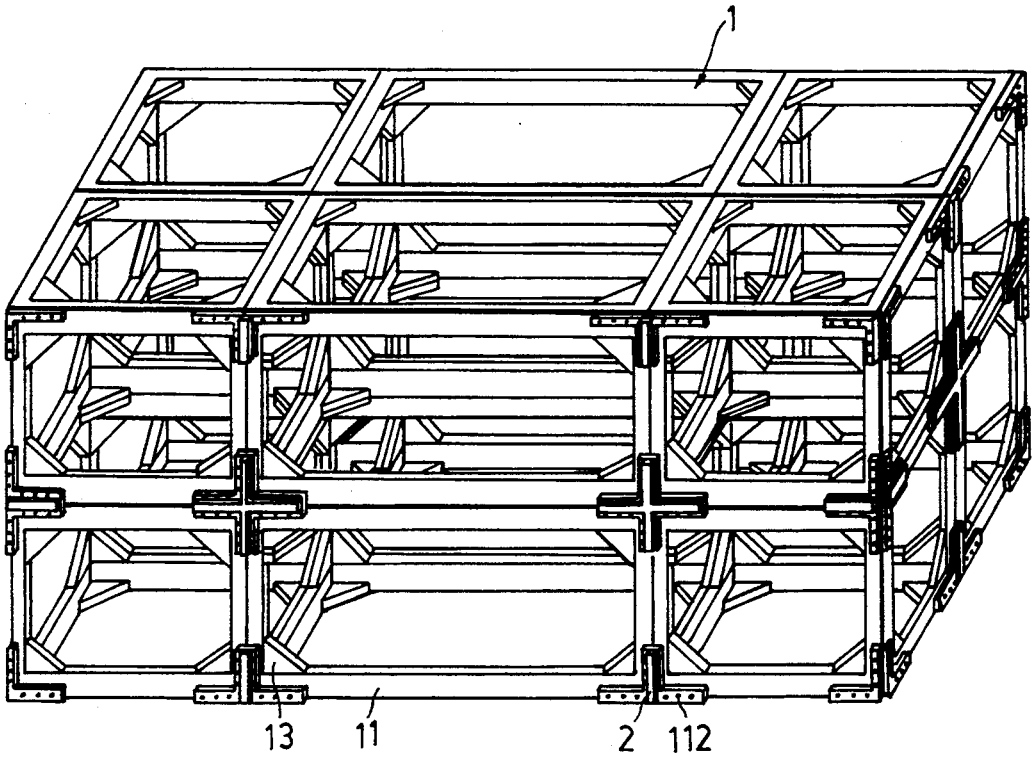
FIG. 10 illustrates several structural units connected horizontally and vertically.
Figure 11:
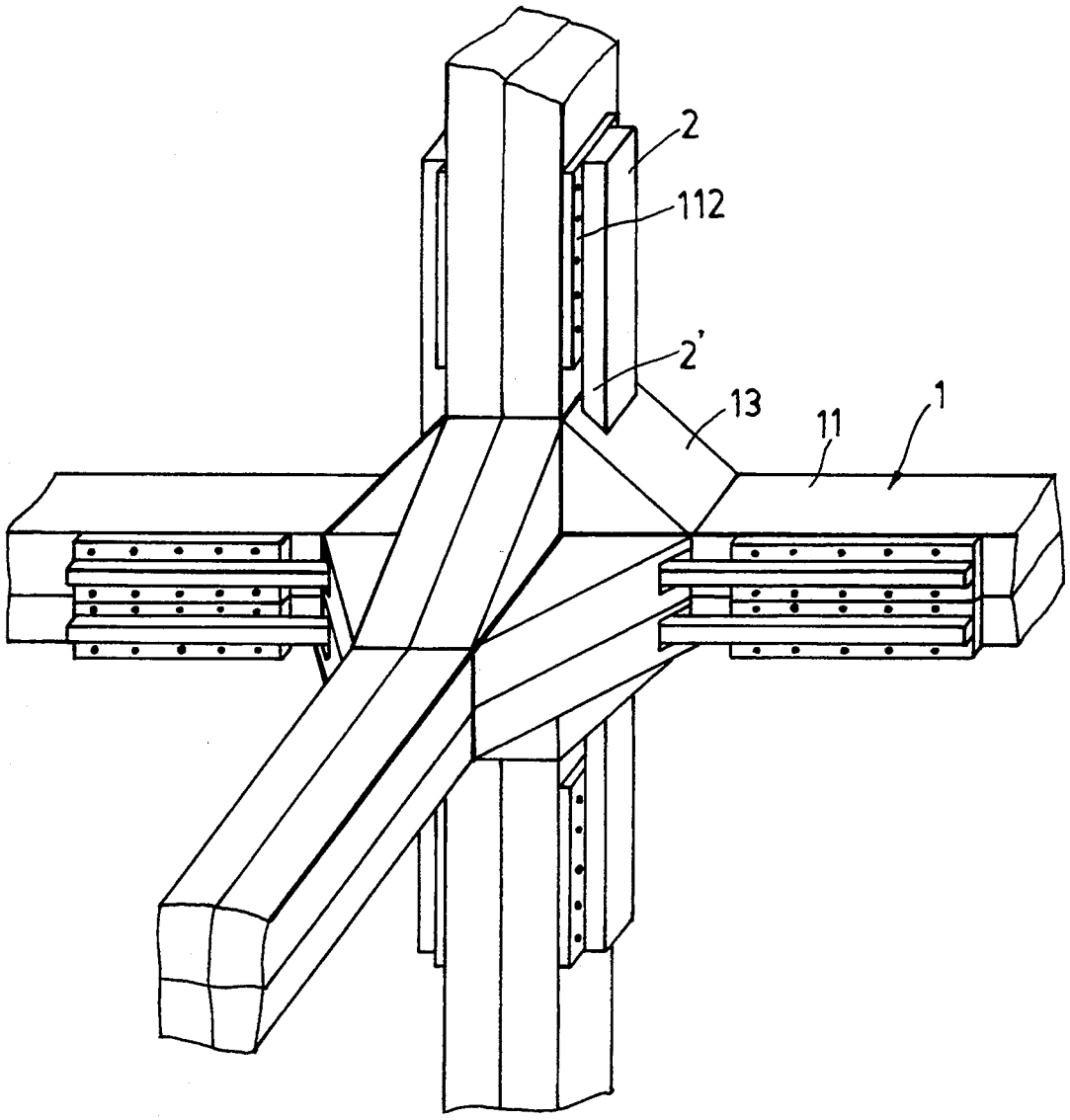
FIG. 11 illustrates connecting steel plates fastened to each structural unit by bolts, and reinforcement plates welded to the connecting steel plates of each two contiguous structural units in connecting the structural units together.

Referring to FIGS. 10 and 11, when various structural units 1 are to be connected longitudinally and latitudinally (see FIG. 10), it is very difficult to weld inside connecting steel plates 112 from the outside. Under this situation, connecting steel plates 112 are respectively fastened to each structural unit 1 by bolts, and then reinforcement plates 2 are respectively welded to the connecting steel plates 112 of each two contiguous structural units 1 in connecting the structural units 1 together. If the building thus constructed is to be pulled down, the reinforcement plates 2 are respectively cut off at portion 2' (see FIG. 11), and the bolts are respectively removed from the connecting steel plates 112, and then the structural units 1 can be separated from one another. For constructing a permanent building, the prepared structural units 1 can be directly fastened together by reinforcement plates 2 through the process of welding. Further, the shape and size of the reinforcing angle irons 13 are determined according to the cross section and stress of the columns and beams to be connected.

Figure 12:
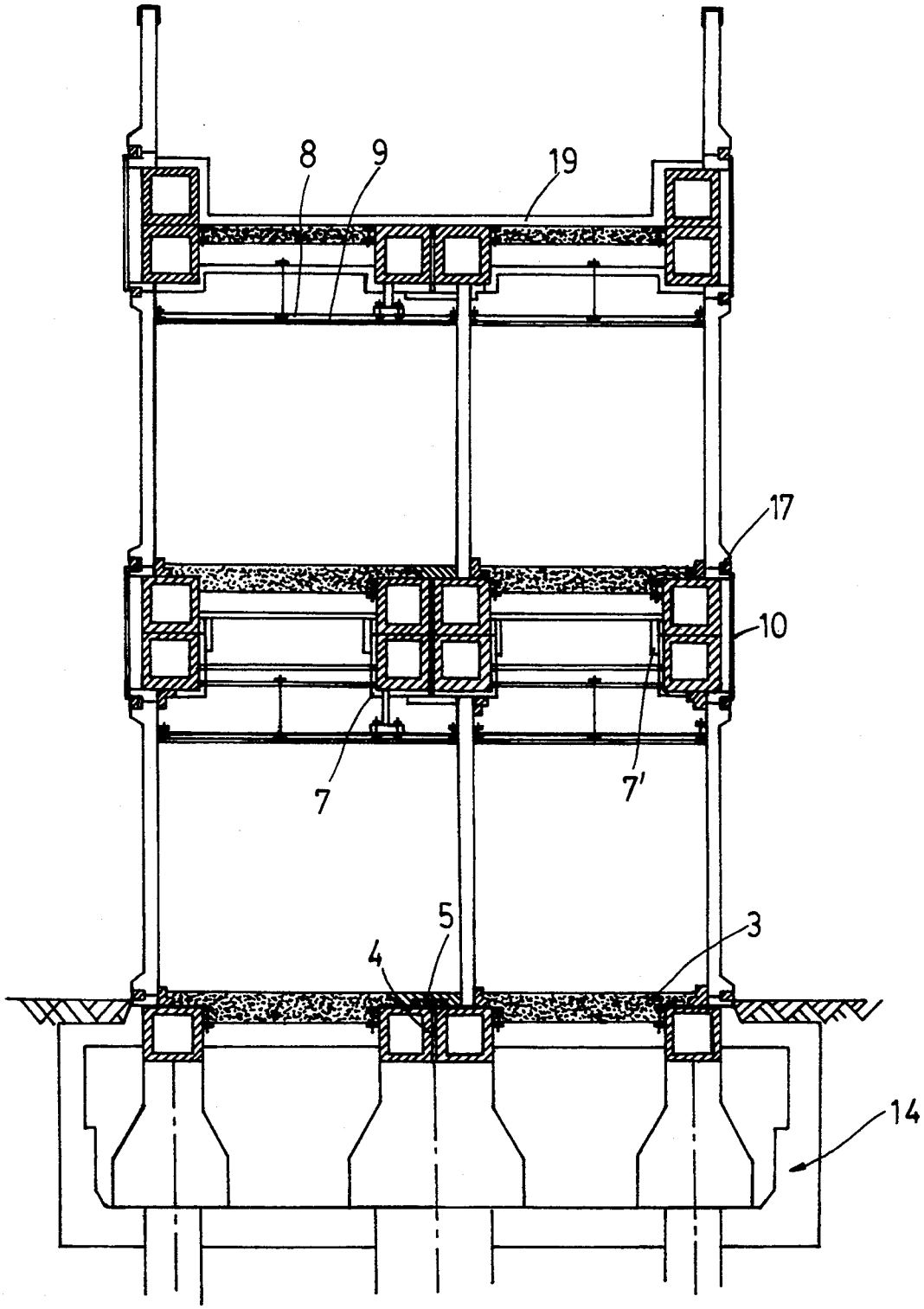
FIG. 12 is a cross section showing the installation of prefabricated wall boards and floor slabs.
Figure 13:
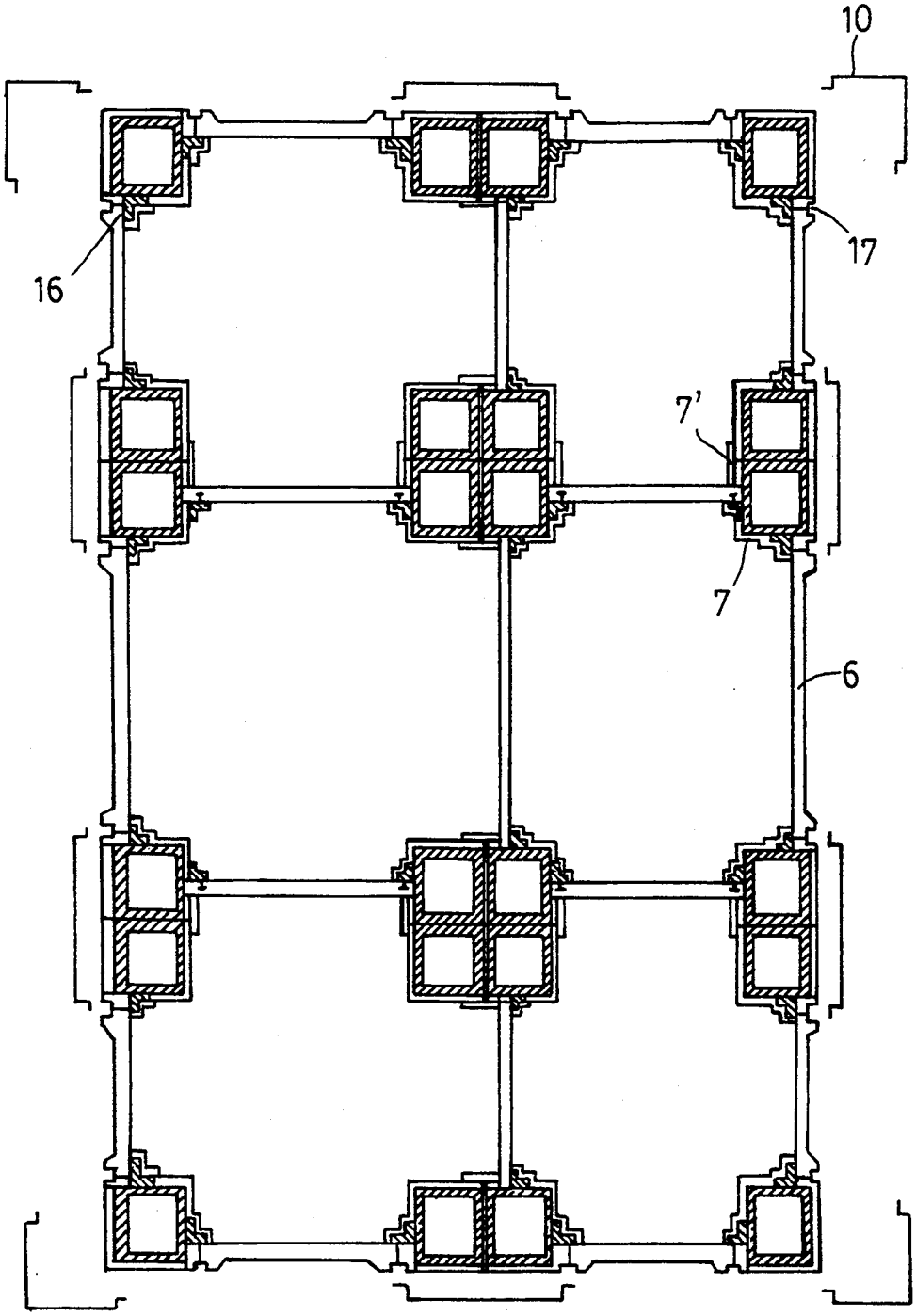
FIG. 13 is a plan view showing the connection of wall boards to the steel-columns of each structural unit.
Figure 14:
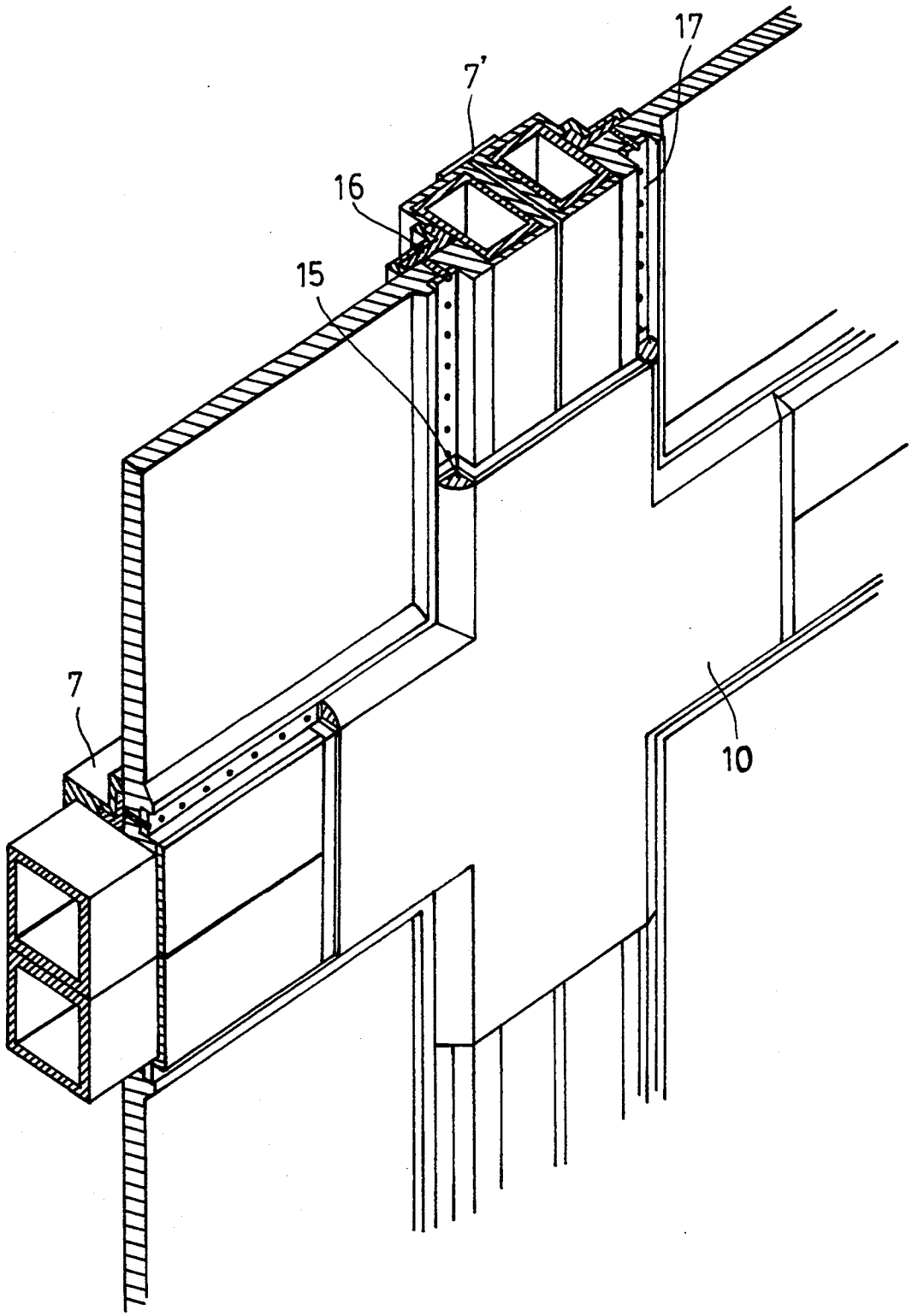
FIG. 14 is a perspective elevational view in an enlarged scale, showing the connection of wall boards to the steel columns of contiguous structural unit.

Referring to FIGS. 12, 13 and 14, when several structural units 1 are connected together, gaps are maintained between the floor slabs of each two contiguous structural units 1. During the assembly process, the spaces for floor beams are respectively filled up with packing material 4 and then covered with concrete 5, and then pre-fabricated floor slabs 3 are matched. Locating steel plates 16 are respectively fastened to each structural unit 1 for mounting exterior wall boards and partition wall boards or the anchors therefor. Wall boards 6 are prefabricated at factory during the production of each structural unit 1. When a building is set up, any partition wall board can be pulled down as desired. Fireproof covering layers 7 are respectively covered over the columns and beams of each structural unit 1 (see FIG. 12). When prepared structural units 1 are connected and set up into a building, the connecting areas among structural units 1 are covered with fireproof covering layers 7 again. Ceiling boards 8 are also prefabricated at factory during the production of each structural unit 1. Spaces 9 are maintained at corner areas during the installation of ceiling boards 8 at factory, which are covered with ceiling boards at the work-yard after the designed building has been set up. Wall boards 6 are fastened to the locating steel plates 16 of each structural unit 1 before the construction. Prefabricated cover panels 10 are then fastened to the grooves 17 on the wall boards 6 by screws or through welding process, after the prepared structural units 1 have been set up at the work-yard, and covered over the columns and beams of all structural units 1. After the installation of cover panels 10, the gaps between the wall boards 6 and the cover panels 10 are sealed by waterproof, heat-resisting filling element 15. Therefore, the exterior water proofing is done. The water proofing of the roof is made according to the type of the prefabricated roof. For example, it shall be done at the work-yard after the construction of the building if the roof is of the type shown in FIG. 12. When set up, load is transmitted to the foundation 14 through the columns and beams of the respective structural units 1 (the foundation 14 is not within the scope of the present invention, and therefore it is not necessary to explain its construction in detail). The wall boards may be made at factory during the production of each structural unit, or installed at the work-yard after the construction of the designed building. Further, the wall boards may be made of reinforced concrete or any of a variety of suitable materials.

As indicated, structural units 1 may be made in different shapes, sizes and load-carrying capacities, and respectively classified for quick construction. The structural load-carrying capacity maybe determined according to different considerations. For example, it may be relatively increased so that the building thus formed can be further extended several years after its construction. The present invention also allows a building to be reassembled. Flexible tolerance is also maintained for the foundation pile. Therefore, the limited land space can be fully utilized. Because structural units and most parts and accessories are prefabricated and then built up at the work-yard, no waste materials will be produced during the construction of a building.

What is claimed is

1. A method of constructing a prefabricated building at a building site comprising the steps of:

a) prefabricating a plurality of structural units of steel columns and beams away from the building site, each structural unit having upper and lower surfaces defining interengaging locating means;

b) transporting the structural units to the building site;

c) arranging the structural units adjacent to each other in a desired configuration;

d) temporarily attaching at least one guide member to a first structural unit;

e) placing a second structural unit on top of the first structural unit such that the at least one guide member positions the second structural unit relative to the first structural unit and the units are located by the inter-engaging locating means of each structural unit;

f) removably attaching adjacent connecting plates to each of the adjacent structural units; and g) fixedly attaching adjacent connecting plates together.

2. The method of claim 1 comprising the steps of forming the inter-engaging locating means by forming a protruding locating cone on one of the upper and lower surfaces and forming a tapered hole on the other of the upper and lower surfaces.

3. The method of claim 1 wherein the connecting plates a removably attached to the structural units by bolts.

4. The method of claim 1 wherein the adjacent connecting plates are attached by welding.

* * * * *